US005178105A

United States Patent [19]

Norris

[11] Patent Number: 5,178,105

[45] Date of Patent: Jan. 12, 1993

[54] VALVE GEAR FOR INTERNAL COMBUSTION ENGINES

[75] Inventor: Robert D. Norris, Surrey, England

[73] Assignee: Ricardo Consulting Engineers Limited, Sussex, England

[21] Appl. No.: 748,624

[22] Filed: Aug. 22, 1991

[30] Foreign Application Priority Data

Aug. 23, 1990 [GB] United Kingdom ..... 9018558

[51] Int. Cl.[5] ..... F01L 1/34

[52] U.S. Cl. ..... 123/90.15; 123/90.17

[58] Field of Search ..... 123/90.15, 90.16, 90.17, 123/90.24, 90.26

[56] References Cited

U.S. PATENT DOCUMENTS

| | | | |
|---|---|---|---|
| 1,885,796 | 11/1932 | Boulet | 123/90.17 |
| 2,814,283 | 11/1957 | Gassmann et al. | 123/90.24 |
| 2,833,258 | 5/1958 | Lorscheidt et al. | 123/90.24 |
| 3,313,280 | 4/1967 | Arutunoff et al. | 123/90.15 |
| 3,888,216 | 6/1975 | Miokovic | 123/90.17 |
| 4,714,057 | 12/1987 | Wichart | 123/90.15 |
| 4,928,650 | 5/1990 | Matayoshi et al. | 123/90.24 |
| 5,052,350 | 10/1991 | King | 123/90.16 |

FOREIGN PATENT DOCUMENTS

| | | | |
|---|---|---|---|
| 384361 | 8/1990 | European Pat. Off. | 123/90.17 |
| 2456752 | 8/1976 | Fed. Rep. of Germany | 123/90.16 |
| 188716 | 11/1982 | Japan | 123/90.17 |
| 30406 | 2/1985 | Japan | 123/90.24 |
| 156109 | 7/1991 | Japan | 123/90.17 |
| 160101 | 7/1991 | Japan | 123/90.24 |

*Primary Examiner*—E. Rollins Cross
*Assistant Examiner*—Weilun Lo
*Attorney, Agent, or Firm*—McAulay Fisher Nissen Goldberg & Kiel

[57] ABSTRACT

Valve gear for an internal combustion engine includes a first cam mounted to rotate about a first axis, a second cam mounted to rotate about a second axis which is substantially parallel to the first axis, a phase-change mechanism arranged selectively to vary the phase of one of the cams relative to the other, a cam follower which has first and second contact surfaces arranged to be engaged by the first and second cams, respectively. The profile of the first cam includes an ascending portion to move the valve member in a second direction opposite to the first direction and a descending ramp to control movement of the cam follower with respect to the valve member. The profile of the second cam includes a descending portion to control movement of the valve member in the first direction and an ascending ramp to control movement of the cam follower with respect to the valve member. The phase of the two cams is such that the times for which the ascending and descending ramps contact the follower at least partially overlap at a time during which the valve member is stationary in the closed position.

12 Claims, 13 Drawing Sheets

VALVE GEAR FOR INTERNAL COMBUSTION ENGINES

BACKGROUND AND SUMMARY OF THE INVENTION

The present invention relates to valve gear for internal combustion engines, that is to say inlet valves and exhaust valves together with the associated actuating mechanism, and is concerned with such valve gear which includes a variable timing mechanism.

It is known that it is beneficial to vary the timing of the exhaust valves and, more particularly, of the inlet valves of an internal combustion engine. At high engine speeds, when the gases flow into and out of the cylinder at high speeds, it is beneficial to open the inlet valve earlier in the engine cycle and close it later in the engine cycle. This maximizes the quantity of inlet gas charge, i.e. fuel and air, entering the cylinder during the inlet period and takes advantage of the inertia of the charge whereby there is relatively little tendency of the inlet charge to flow directly from the inlet port out of the exhaust port.

At low engine speeds, later opening of the inlet valve is desirable to minimize the amount of inlet charge flowing directly into the exhaust port from the inlet port. This bypassing flow reduces engine power and efficiency by reducing the mass of the charge left in the cylinder for combustion, and increases the amount of hydrocarbons in the exhaust gas because the inlet charge contains unburned fuel. Earlier closing of the inlet valve at low engine speeds is desirable to minimize the amount of inlet charge flowing back into the inlet port during the compression stroke.

Many mechanisms have been proposed which provide variable valve timing (VVT), but they all have major limitations.

A known VVT mechanism, which is of the type disclosed in GB-A-170877, is illustrated diagrammatically in FIG. 1. This includes first and second cams 1 and 5 mounted on respective, parallel cam shafts 2 and 6. Spanning the two cams is a beam 9, which may also be described as a cam follower. The follower includes a respective cam-contact pad 4 and 8 at each end, which contact the cams at points 3' and 7' on respective cam-contact surfaces 3 and 7.

The follower 9 is centrally pivoted on a pin 150 which connects it to a lateral-restraint rod 152 pivoted about a fixed point 151. The rod 152 has a valve-contact pad 153 which is in contact with the end 10 of the valve member 13 of an engine inlet valve. The valve member is biassed towards the closed position by a spring 12, which acts on it via a spring retainer 11. Hence, any net downward movement of the follower creates a downward movement of the valve member, which is resisted by the spring.

The axis 14 of the valve member 13 is midway between the axes of the cam shafts 2 and 6. Therefore the lift or displacement at the valve at any time is equal to half the lift of cam 1 plus half the lift of cam 5 at that same time. This is illustrated diagrammatically in FIG. 2, which shows lift against time and in which the two cams are in phase. In FIG. 2*a*, L1 represents half of the lift of cam 1. In FIG. 2*b*, L2 represents half of the lift of cam 5. In FIG. 2*c*, L1+L2 represents the lift of the valve which lasts for a time Pa and rises to a maximum of La.

FIG. 3 is similar to FIG. 2 and shows the effect if cam 5 is given a phase shift S so that it is retarded relative to cam 1. The effect on valve lift is shown in L1+L2 in FIG. 3*c*. It will be noted that the maximum lift Lb of the valve is less than the maximum lift La in FIG. 2*c* when the cams are in phase, and the valve period Pb is greater than the original period Pa.

Thus, the valve opening period and lift are varied by advancing or retarding the phase of one camshaft relative to the other camshaft.

A typical cam for an internal-combustion engine has the characteristics shown in FIG. 4. FIG. 4*a* shows the curve of lift or displacement, L, of the valve on the Y axis against time on the X axis. During the cam period de the lift curve is concave. During the cam period efg the lift curve is convex. During the cam period kh the lift curve is concave. The lift is a maximum at point j, corresponding with point f on the period axis.

The corresponding diagram of velocity V is shown in FIG. 4*b*. During the opening period def the valve reaches its maximum opening velocity at 1. During the closing period fgh the valve reaches its maximum closing velocity at m.

The corresponding acceleration A is shown in FIG. 4*c*. During the period de the valve experiences a positive acceleration which reaches its maximum at n. During the period efg the valve experiences a negative acceleration which reaches its maximum at o. During the period gh the valve experiences a positive acceleration which reaches its maximum at p.

When two cams of this type are used in valve gear of the type illustrated in FIG. 1 the results are as shown in FIGS. 2 and 3.

Although, when the cams are out of phase, the lift curve is apparently smooth, there is a dynamic problem which is clearly evident if the acceleration diagram, FIG. 4*c*, is considered. Since the inertia forces involved are directly proportional to the magnitude of the accelerations, the acceleration curves are a good indicator of the VVT's ability to operate at high speed. At high speeds, excessive inertia forces cause excessive vibration and excessive mechanical stresses.

FIG. 5 shows the case where the two cams are out of phase by 12.5% of the cam period. FIG. 5*a* shows the acceleration curves of the two cams in this condition. FIG. 5*b* shows the acceleration of the valve. The new period is dte"f"g"wh", which is 12.5% longer than when the cams are in phase. Acceleration is defined by the curve dstue"o"g"vwxh". Points suvx identify four acceleration peaks, which are likely to cause severe vibration problems.

Clearly, it is not possible to use conventional cams at high speeds in a VVT of this type.

FIG. 6 shows the characteristics of the cams of the valve gear of FIG. 1 which attempt to overcome this problem. FIG. 6*a* shows the lift characteristics of the first cam. FIG. 6*b* shows the lift characteristics of the second cam. FIG. 6*c* shows the valve lift characteristic which occurs when the two cams are out of phase as shown. The first cam has a dwell period bd during which the lift of the cam remains constant, as shown by the line jq. The second cam has a dwell period fh during which the lift of the cam remains constant, as shown by the line rp.

It should be noted at this point that backlash is a small degree of clearance between the moving components when the valve member is not being activated, i.e. when the valve is closed. Backlash is necessary to allow the individual components to undergo thermal epansion when the engine is hot without opening the valve unintentionally during its closed period. Free movement is relatively large scale movement of the components in VVT's of the type described in which the components are separated by an amount greatly in excess of the backlash during some part of the valve operating cycle. Free movement is sufficiently large to preclude the use of conventional means of controlling backlash.

The valve gear shown in FIG. 1 includes a large free movement, shown as X in FIG. 6*c*, between the follower and the valve stem or between the follower and the cams. The lift L1 generated by the first cam is sufficient only to take up this free movement. This is illustrated by the line aj in FIG. 6*c*. At time c in the valve period the second cam begins to move the follower and, after taking up any backlash in the system, adds its lift L2 to the lift generated by the first cam. The result is valve lift, as shown by the cross-hatched area in FIG. 6*c*. By changing the phase angle between the two cams the magnitude and period of this lift may be varied.

As mentioned earlier, free movement is an undesirable characteristic in a high speed mechanism and many attempts have been made to overcome the problem. A notable example is disclosed in SAE paper 890676 which describes an improved VVT mechanism of the general type illustrated in FIG. 1. However, like all its predecessors the mechanism is bulky relative to a conventional fixed-period direct-attack valve mechanism and is not suited to high speed operation. These problems are mainly due to the fact that the mechanism incorporates a free movement compensation device to take up the free movement inherent in the system.

It is thus an object of the present invention to provide valve gear of the type including a VVT mechanism operated by more than one cam per valve in which the free movement or clearance between the components is substantially zero thereby permitting a backlash adjuster or compensator to be used, if desired, and also permitting the valve gear and thus the associated engine to be run at high speeds without the generation of substantial shock loads and noise.

According to the present invention there is provided a valve gear for an internal combustion engine including a first cam mounted to rotate about a first axis, a second cam mounted to rotate about a second axis which is substantially parallel to the first axis, a phase-change mechanism arranged selectively to vary the phase of one of the camshafts relative to the other, a valve member movable along a valve axis, biassing means urging the valve member in a first direction along the valve axis and a cam follower which has first and second contact surfaces arranged to be engaged by the first and second cams, respectively, and is arranged to transmit movement from the cams to the valve member, but is movable with respect to the valve member, characterised in that the profile of the first cam includes an ascending portion to move the valve member in a second direction opposite to the first direction and a descending ramp to control movement of the cam follower with respect to the valve member, that the profile of the second cam includes a descending portion to control movement of the valve member in the first direction and an ascending ramp to control movement of the cam follower with respect to the valve member, that the gradient of the ascending ramp and of the descending ramp are substantially the same over at least part of their length and that the phase of the two camshafts is such that the times for which the ascending and descending ramps contact the follower at least partially overlap at a time during which the valve member is stationary in the closed position and the cam follower moves with respect to the valve member.

In the construction illustrated in FIG. 1, when the valve member is in the closed position and can move no further in the closing direction due to its engagement with the valve seat, one or both of the cams moves away from the follower and the free movement appears and must be taken up again at a later stage in the cycle before the valve member can be moved by the cams. However, in the present invention, when the valve is closed the follower is engaged by the ascending and descending ramps whose gradient is the same and whose maximum height is preferably also the same which means that their combined height, that is to say the combined lift which they exert on the cam follower, remains constant and as the descending ramp tends to move away from the follower the follower is constrained to move with it by the ascending ramp. This means that the free movement does not open up at all and that the cams remain in constant contact with the follower at all times or spaced from it by a distance which is only the usual backlash distance which can be compensated for by a backlash adjuster.

In other words, the action of the ascending and descending ramps cancels out during the overlap period and the axial position of the follower along the axis of the valve member remains substantially constant and the cams remain substantially in contact with the cam follower which is therefore caused to move by the engagement of the cams. Hence the free movement is substantially zero during this period.

However, the axial position of the follower during the overlap period is dependent on the relative phasing of the two camshafts. Hence the backlash in the system varies with the varying phasing of the camshafts. For this reason it is preferred that there is a backlash adjuster, preferably of hydraulic type, e.g. acting on a tappet whereby any potential backlash in the system may be reduced to zero regardless of the phase of the camshafts.

In a wholly mechanical system in which there is no backlash adjuster or compensator, the valve motion may be optimised if the profile of each cam includes a portion of zero gradient adjacent the portion of maximum and of minimum lift.

The two cams may be carried by respective parallel cam shafts or by a single cam shaft associated with the phase change mechanism. In this case the axes of the two cams will be coincident and the follower may be of generally V shape or trough shape with outwardly inclined sides which afford the contact surfaces.

The cam follower may be of the type illustrated in FIG. 1, i.e. with the two contact surfaces generally coplanar, and in this event the movement of the follower relative to the valve member when the valve is closed will be pivotal movement. One disadvantage of this arrangement is that the lift of the valve is equal to the lift of each individual cam, assuming that the lift on each cam is the same. The volume occupied by the camshafts is however double that of a single direct-attack camshaft. Another disadvantage is that the pivot 150 is very highly loaded and rod 151 is needed for lateral location of the follower beam. This rod is bulky and adds to the weight, cost and space of the valve gear.

However, in a preferred embodiment in which the cams may be smaller than in the construction of FIG. 1 and the lateral location rod may be omitted entirely, whereby the valve gear is cheaper, lighter and simpler, the first and second contact surfaces are inclined to the valve axis by an acute angle of 15° to 70°, the cam follower is movable transverse to the valve axis by the engagement of the cams and is constrained to move only substantially parallel to the valve plane in which the valve axis lies and which extends perpendicular to the two cam shafts.

The follower may act directly on the valve member but it is preferred that it acts indirectly via a tappet. The follower may be restrained to move parallel to the valve plane, and preferably substantially in the valve plane, by numerous means, e.g. by being restrained in a groove or recess in the cylinder head or an additional plate or by the provision of one or more flanges on the follower or tappet which engage in grooves or over the edges of the tappet or follower. A further possibility is that the tappet has an upstanding boss of at least part-circular section which is received in a groove in the underside of the follower whereby a degree of rotational movement of the follower or tappet is possible.

In its simplest form the cam follower is in the shape of a triangular prism with two planar surfaces which constitute the cam contact surfaces. However, these two surfaces may be either concave or convex. Alternatively, the cam follower may be of more complex shape but preferably still includes two cam contact surfaces which are inclined to one another and to the valve axis. In a further possibility, the cam contact surfaces are constituted by rollers or the like carried by the follower and in this event the actual shape of the follower is of no importance. If the cam contact surfaces are circular or arcuate it will be appreciated that what is of importance is that, when viewed in the direction of the length of the camshafts, the tangents at the points of contact of the cams and the contact surfaces, are inclined to the valve axis by 15° to 70°.

Alternatively, the cam follower may be generally in the shape of a letter V including two divergent lugs whose opposed surfaces constitute the contact surfaces. In this event, the cams will not be carried by separate cam shafts but on a single cam shaft. The opposed contact surfaces will in practice not be directly opposed but will be slightly offset in the direction of the length of the cam shaft so that they can be engaged by the respective cams. This can tend to cause the cam follower to rotate about the valve axis and thus a further possibility is to divide one of the two cams into two halves which have the same shape and angular position and are spaced apart and separated by the other cam. In this case, the construction of the cam follower will be modified similarly and one of the inclined lugs is also divided into two halves which are spaced apart in the direction of the cam shaft, the other lug being opposed to the gap between the two halves. This arrangement ensures the elimination of the tendency for the cam follower to rotate.

The invention also embraces an engine including one or more cylinders, the inlet and/or outlet port(s) of which are controlled by such valve gear.

Further features and details of the invention will be apparent from the following description of certain specific embodiments.

DESCRIPTION OF THE PREFERRED EMBODIMENTS

Figure 7:
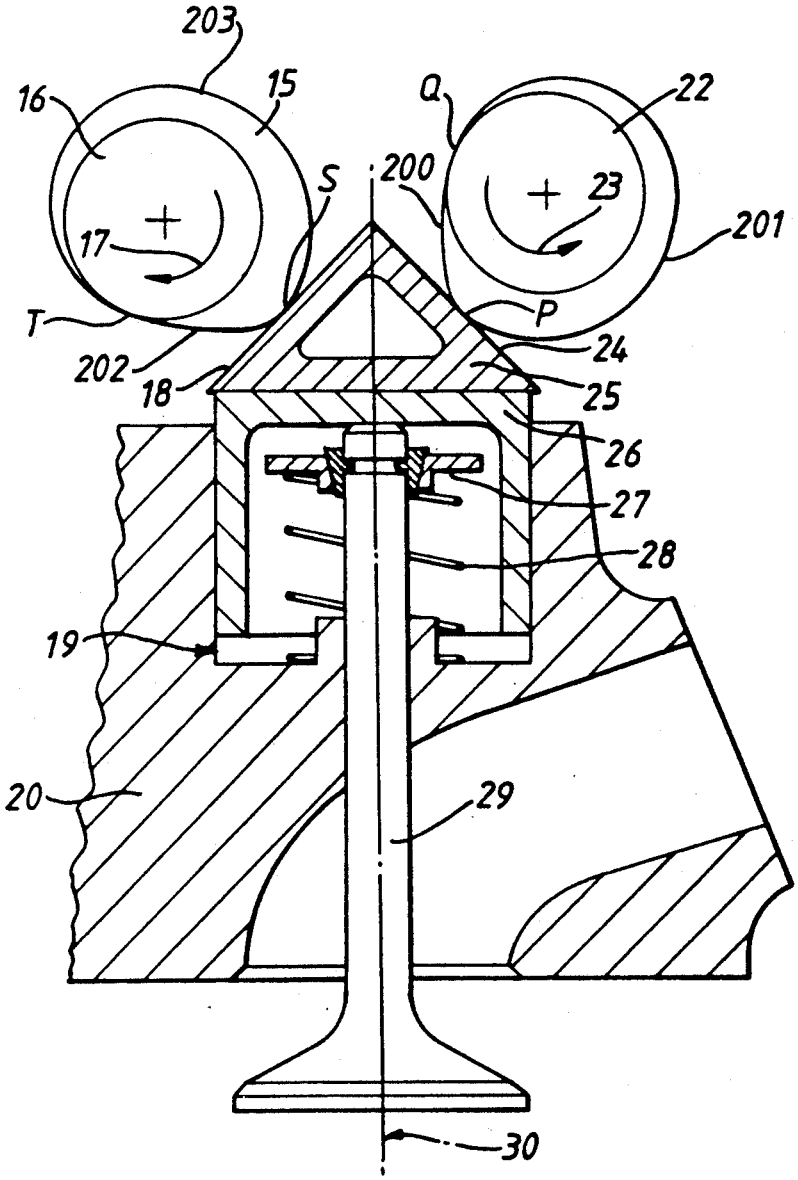
FIG. 7 is a side elevation of valve gear in accordance with the invention.

Referring firstly to FIG. 7, a first planar cam 15 is carried by a first cam shaft 16 for rotation in the direction of the arrow 17. A second planar cam 21 is carried by a second cam shaft 22 for rotation in the direction of the arrow 23. The first and second cams contact a prismatic triangular follower 25 at respective contact points on respective cam contact surfaces 18 and 24. The follower 25 is in horizontal sliding contact with the upper face of a tappet 26. The tappet is vertically slidably received in a recess 19 in the cylinder head 20 of an engine.

Vertical movement of the tappet 26 causes vertical movement of the inlet valve member 29 along the axis 30 of its stem. The inlet valve is biassed towards the closed position by a spring 28 which acts upon the valve member 29 via a spring retainer 27.

The triangular follower 25 is constrained to move only in the plane of the diagram. This plane may also be described as the valve plane since it passes through the first cam and the second cam perpendicular to the two cam shafts and includes the valve axis.

The above description relates to a valve gear in which the valve is biassed to the closed position, and the cams are used to push the valve open. However the converse is also possible, i.e. the valve can be biassed towards the open position and the cams used to push the valve to the closed position.

The second cam 21 has a profile which includes a descending portion 200 extending from point P in the clockwise direction to point Q and the remainder of its profile constitutes an ascending ramp 201 of substantially constant gradient. The first cam 15 has a profile which is the mirror image of the second cam and thus has an ascending portion 202 from point S in the clockwise direction to point T and the remainder of its profile constitutes a descending ramp 203 of substantially constant gradient.

Figure 8:
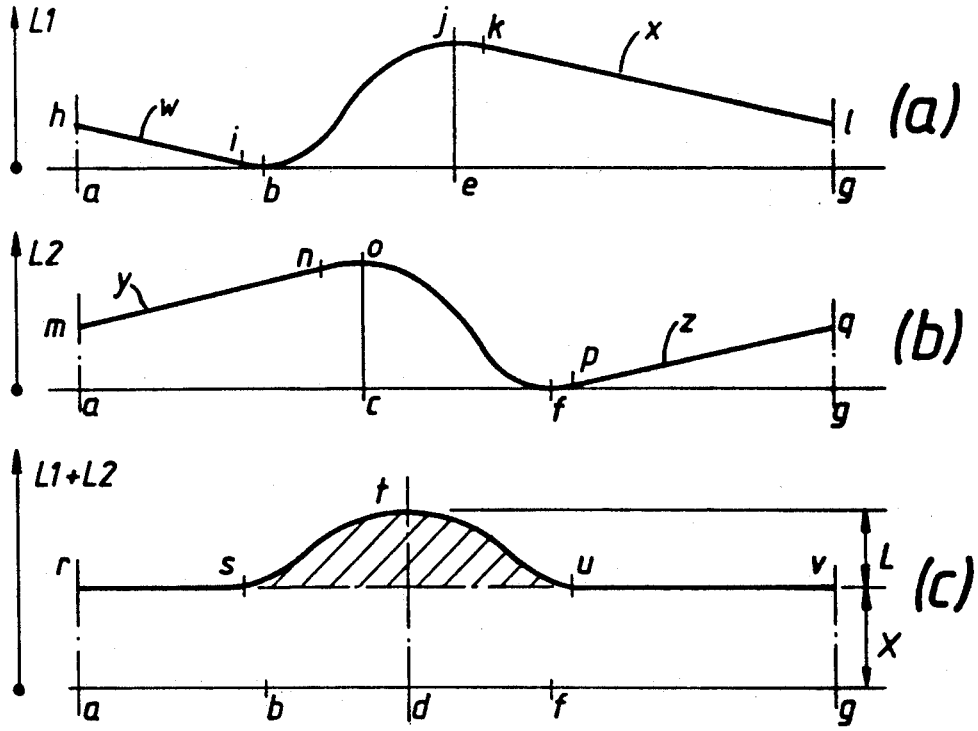
FIGS. 8*a–c* and 9*a–c* show the lift and acceleration characteristics, respectively, of the valve gear of the present invention.
Figure 9:
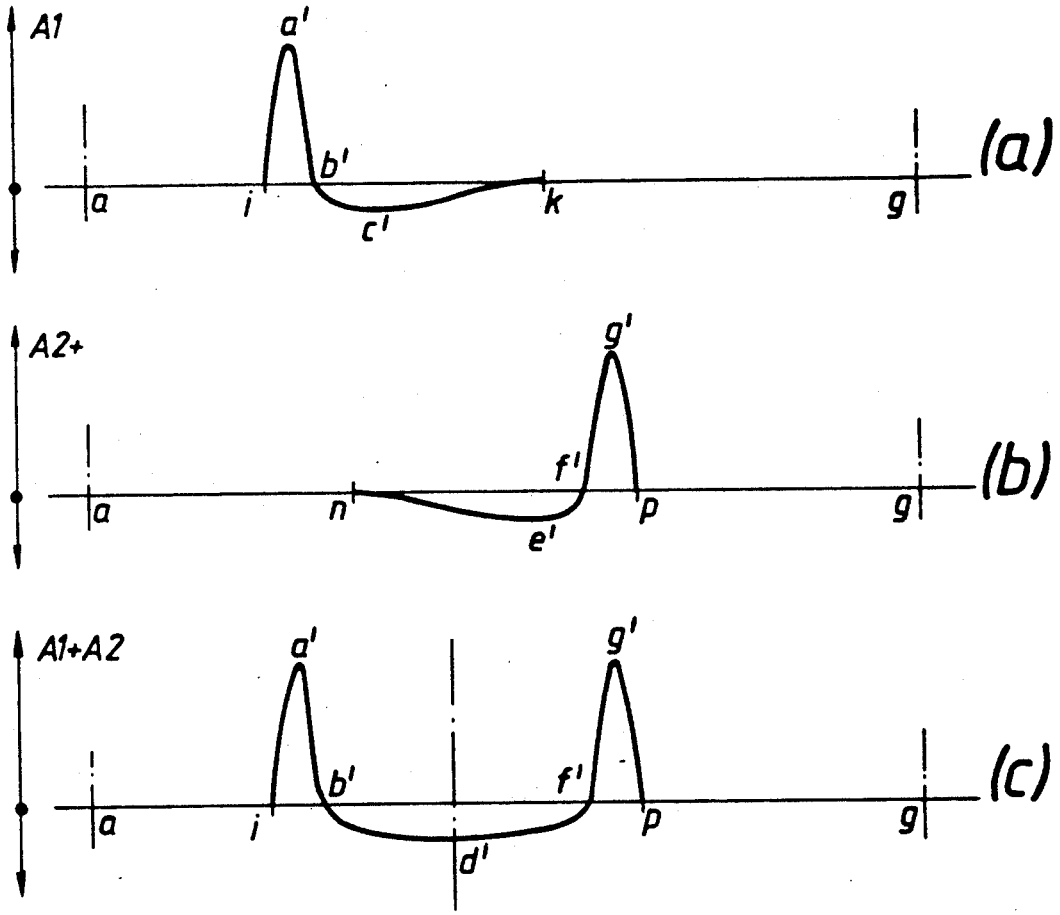

FIGS. 8 and 9 show the characteristics of the cams of the valve gear of the present invention with the cams phased to produce a long valve period. FIG. 8*a* shows the lift curve L1 for the first cam. FIG. 8*b* shows the lift curve L2 for the second cam. FIG. 8*c* shows the valve lift (shaded area) when the two cams are phased as shown.

The cam period a to g occupies 360° rotation so the diagrams should be seen as continuous curves. Hence velocity ramps w and x produced by the first cam are parts of a single ramp, and velocity ramps y and z produced by the second cam are parts of a single ramp. Effectively, the external profile of each cam includes two portions: a constant velocity ramp and an active portion. In the case of the first cam the active portion provides valve lift and in the second cam the active portion controls the reduction of valve lift. The active portion on the first cam produces the lift from points i to k. The active portion of the second cam controls the reduction of lift from points n to p. At point i of the first cam the active profile begins. However, due to the downward velocity of the velocity ramp at that point, minimum cam lift is not achieved until point b. Cam lift then increases until it reaches a maximum at point j. At point k lift starts to decrease and the cam produces a downward velocity which matches that of the ramp. For the second cam (FIG. 11*b*) the ramp has a constant velocity in the opposite sense.

When the cam lifts L1 and L2 are added, the result is valve lift as shown in FIG. 8*c*. The gradient of ramp wx is equal and opposite to the gradient of ramp yz. Hence they cancel and provide no valve movement during the period uvrs.

Figure 6:
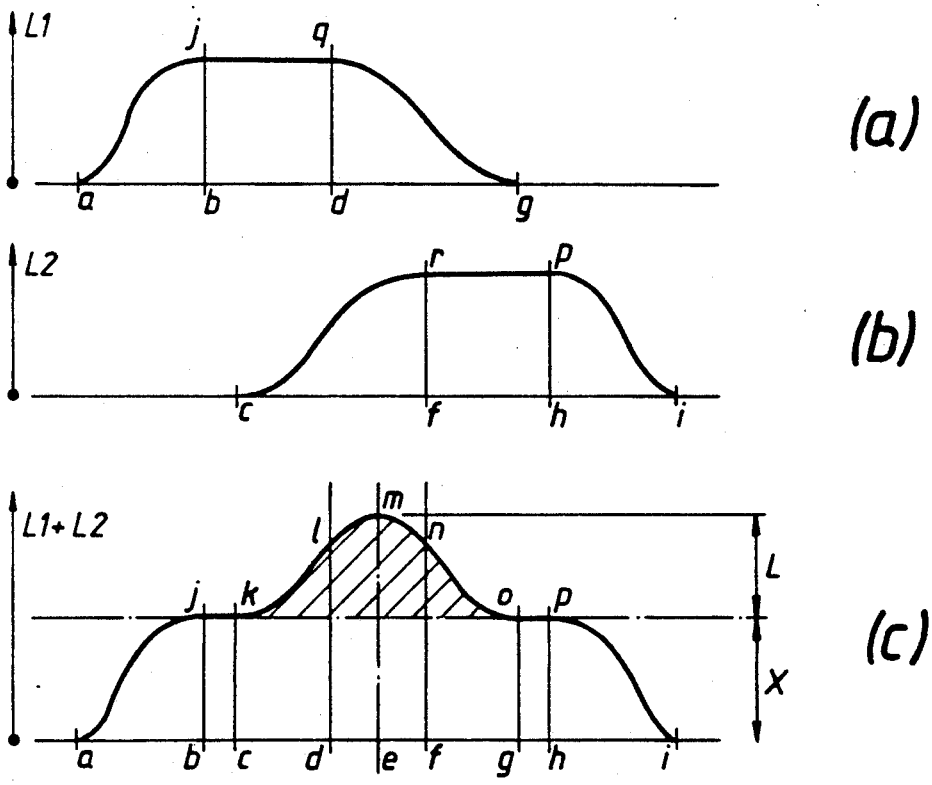
Fig.6. PRIOR ART

It is crucial to the understanding of the invention to observe the differences between FIG. 6, showing the known VVT cam lift profiles and those shown in FIG. 8 for the subject of the invention. In FIG. 8, valve lift is generated along the line stu, producing a maximum lift of L. The dimension X is a constant offset (as opposed to a variable offset as in FIG. 6) from the baseline of the cams and by suitable dimensioning of the components, can be reduced to zero thereby leaving only the required minimum backlash and eliminating the free movement of the components.

Figure 1:
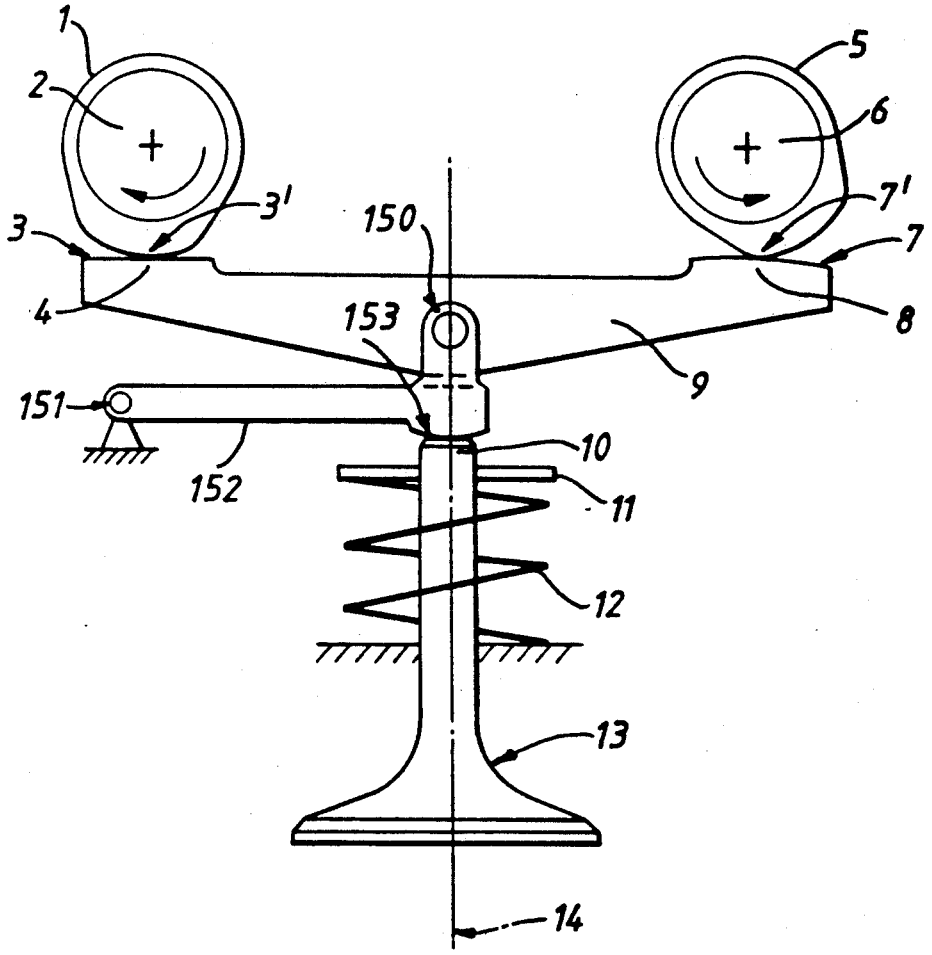
Fig.1. PRIOR ART
FIGS. 1,*2a–c*, 3*a–c*, 4*a–c*, 5*a*, 5*b*, and 6*a–c* show a prior art valve gear system.
Figure 2:
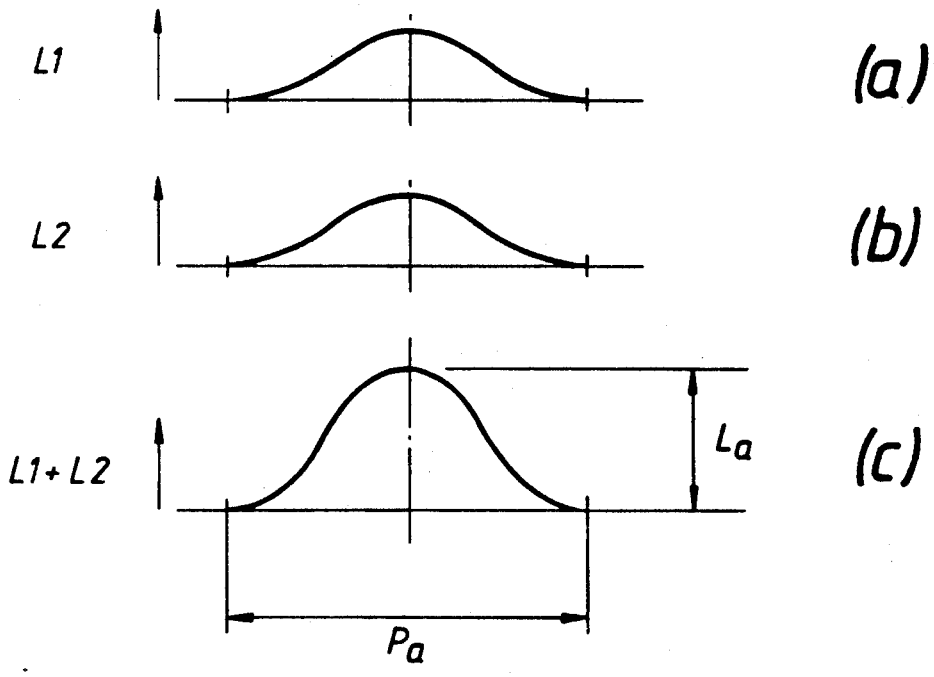
Fig.2. PRIOR ART
Figure 3:
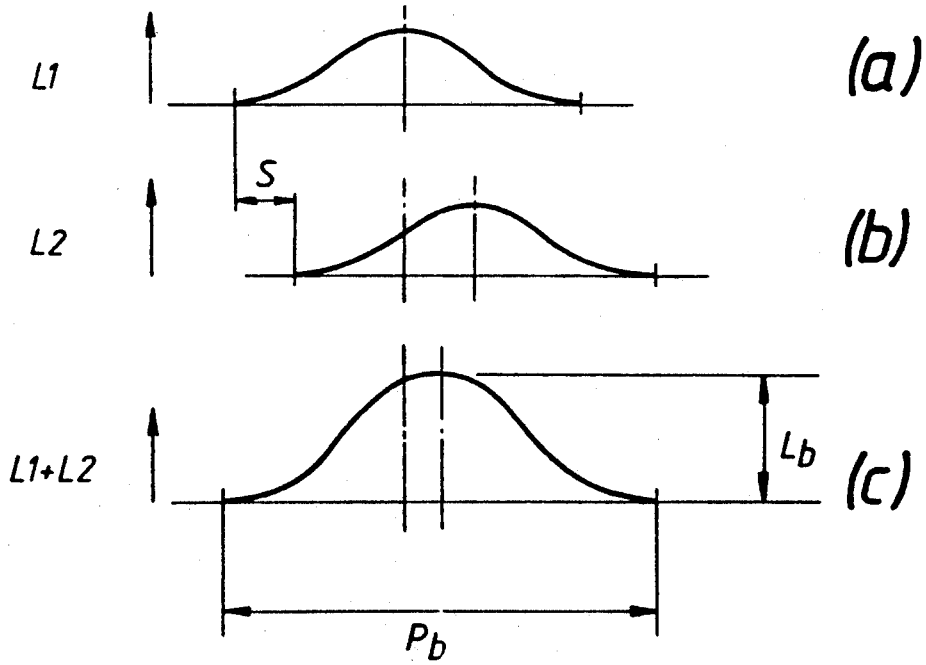
Fig.3. PRIOR ART
Figure 4:
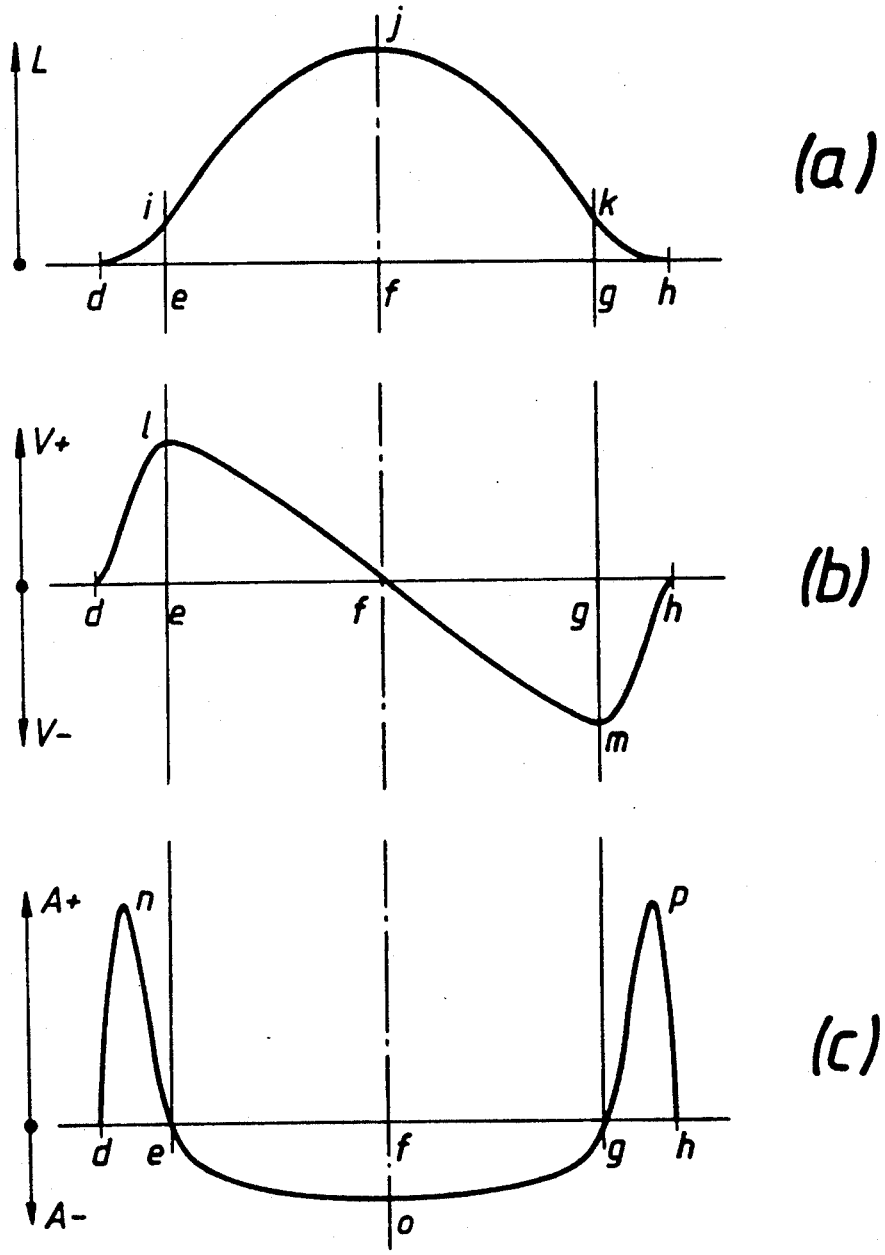
Fig.4. PRIOR ART
Figure 5:
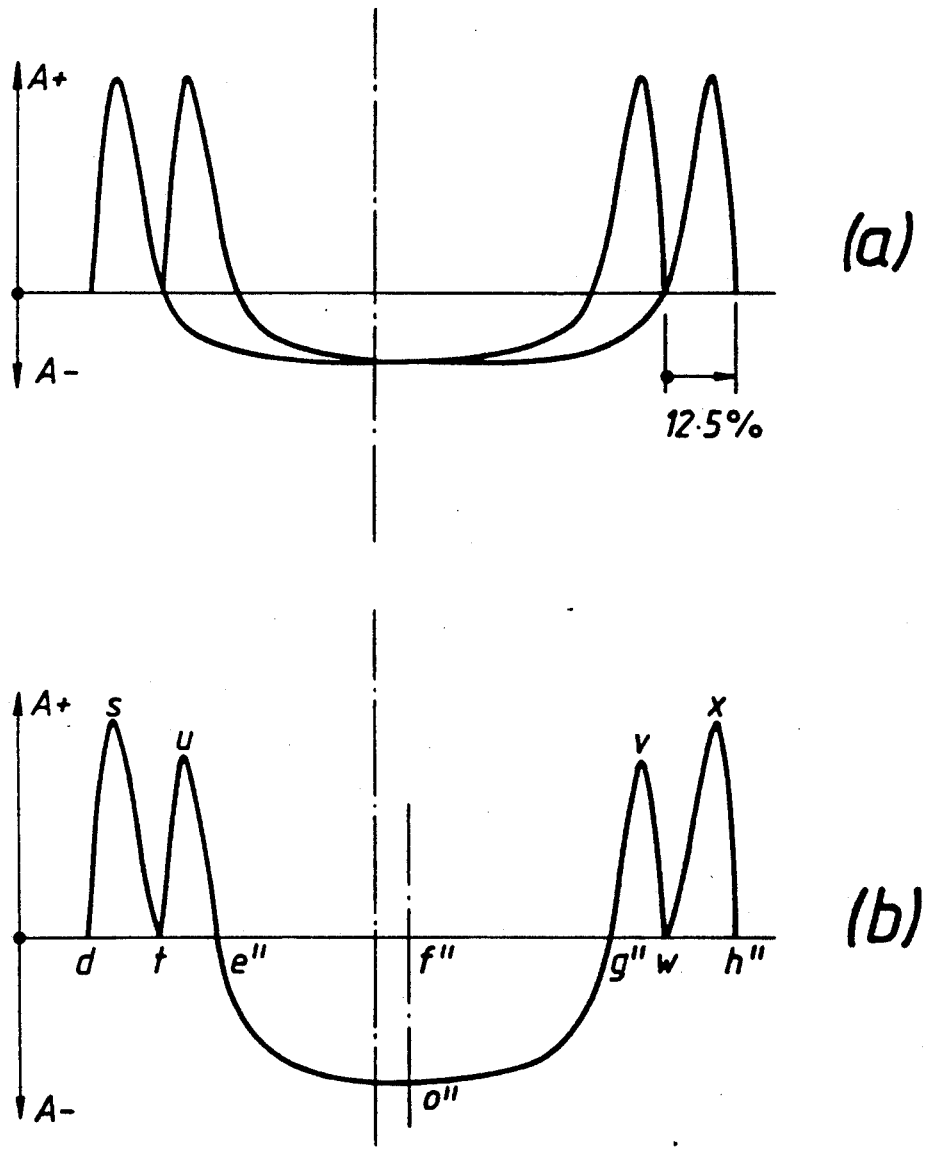
Fig. 5. PRIOR ART

FIG. 9 shows the acceleration characteristics of the two cams. In the first cam (FIG. 9*a*) acceleration begins at i and reaches a maximum positive value at a' before falling to zero at b'. Acceleration continues into a negative phase with a peak value at c' before returning to zero at k. The most noteworthy feature is that there is only a single positive-acceleration period. Conventional cams have two positive-acceleration periods, as shown in FIG. 4*c*.

The consequence of only a single positive-acceleration period is that the lift at point k is not the same as the lift at point i. In effect the first cam is an opening cam; it can open the valve, but it cannot close the valve. Similarly, the second cam is in effect a closing cam. Its acceleration characeristics are a mirror image of those of the first cam, as shown in FIG. 9*b*. It begins a period of negative acceleration at n, which peaks at e' before returning to zero at f'. Acceleration then enters a positive phase, peaking at g' and returning to zero at p.

When these two accelerations are combined, the resulting acceleration characteristic of the valve is as shown in FIG. 9*c*. By careful shaping of the acceleration curves of each individual cam it is possible to produce a valve acceleration characteristic which is close to that obtainable with a single direct-attack cam.

Figure 10:
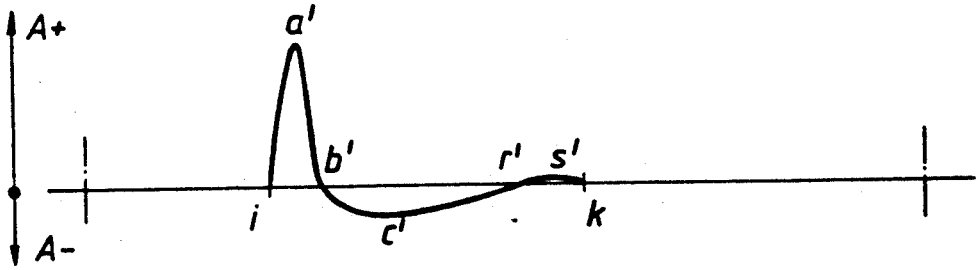
FIG. 10 shows the acceleration characteristics of a modified construction of valve gear in accordance with the invention.

In some circumstances it may be beneficial to modify the acceleration curve of the first cam shown in FIG. 9*a* to that shown in FIG. 10. The modified curve ia'b'c'r's'k has a small secondary positive-acceleration period r's'k. This curve may be helpful in making the acceleration curve of the valve smoother over the whole range of valve periods.

Figure 11:
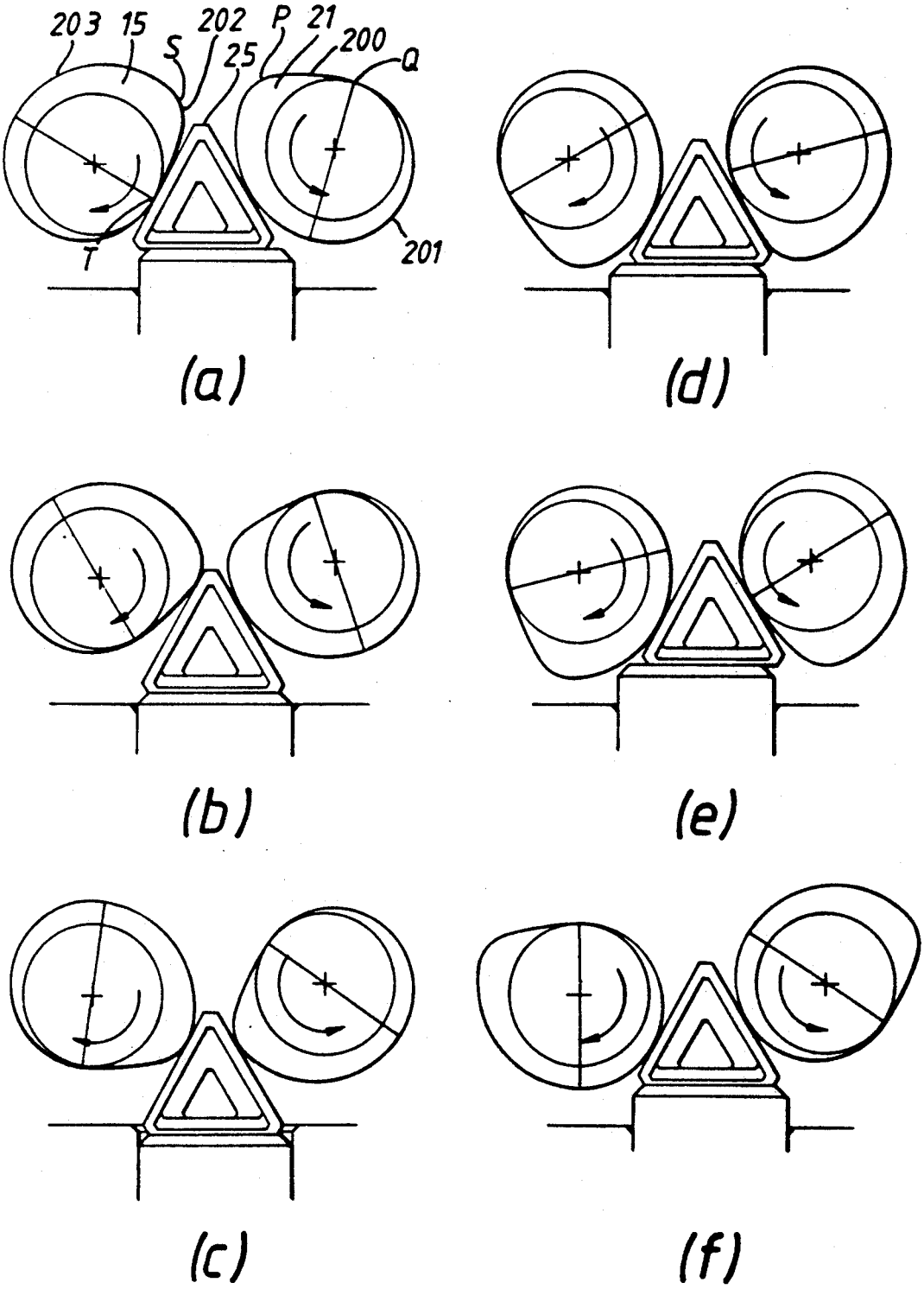
FIGS. 11*a–f* show diagrammatic side elevations of modified valve gear in accordance with the invention at various stages in the cycle.

FIG. 11 illustrates the effect of the cam profiles when the cam follower is of triangular shape. In FIG. 11*a* lift is just starting with the follower 25 in its extreme leftward position. In FIG. 11*b* lifting is progressing. In FIG. 11*c* the valve is at full lift. In FIG. 11*d* the lift is decreasing. In FIG. 11*e* the valve has returned to its seat and has zero lift. The follower is in its extreme rightward position. In FIG. 11*f* the cams are both on their ramps, so that the motion of the follower is from right to left in a purely horizontal direction with no vertical component.

In FIG. 11 the first cam 15 is positioned with its camshaft 16 lower than the camshaft 22 of the second cam 21. This reduces the overturning moment on the follower.

Figure 12:
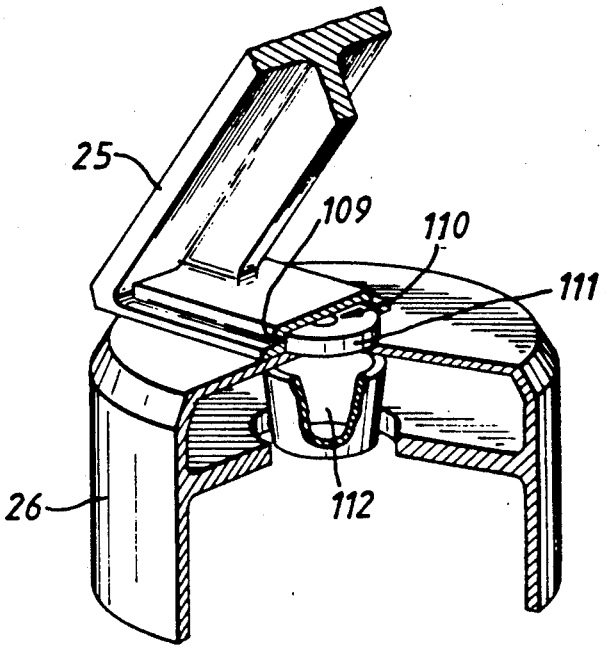
FIG. 12 is a cut-away perspective view of the follower and tappet of the valve gear in accordance with the invention.

FIG. 12 shows a cut-away view of a triangular follower 25 in contact with the tappet 26. A small spigot 111 on the crown of the tappet 26 is in sliding engagement with the channel 109 in the base of the follower 25. The spigot 111 may optionally have an oil-feed hole 110 to supply oil to the sliding contact surfaces. The spigot may also be used in conjunction with alternative follower shapes.

As mentioned above, the free movement in the valve gear of the present invention remains substantially constant over each cycle whilst the valve is closed and by appropriate dimensioning of the various components it is possible to arrange for it to be zero. However, the magnitude of the backlash varies with the phase difference. The mechanism of this effect will be described in more detail below. FIG. 12 therefore shows a hydraulic backlash adjuster 112 which is arranged to adjust the vertical position of the tappet to take up the backlash.

Figure 13:
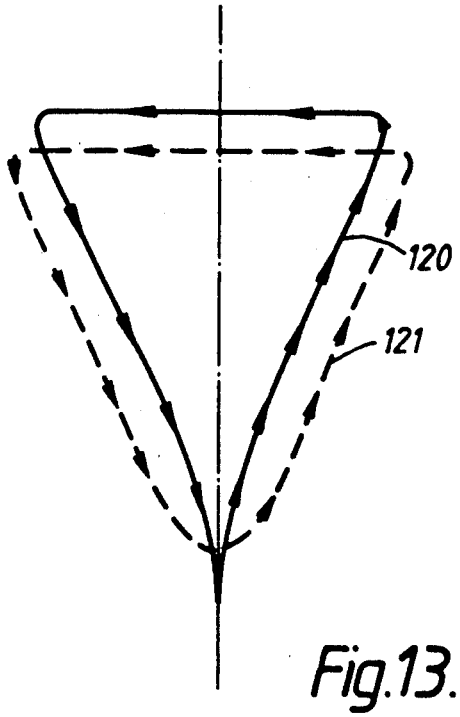
FIG. 13 diagrammatically illustrates the motion of the follower relative to the cylinder head.

As stated above, the follower is constrained to slide in the valve plane only i.e. the follower has two degrees of freedom. The tappet too has two degrees of freedom. It may move axially along the valve axis, and it may rotate about the valve axis within the channel 109 in the base of the follower 25. The motion of the follower 25 relative to the cylinder head 20 is shown in FIG. 13. Orbit 120 is for long valve periods when the cams have a maximum phase difference. Orbit 121 is for short valve periods when the cams have a minimum phase difference.

Figure 14:
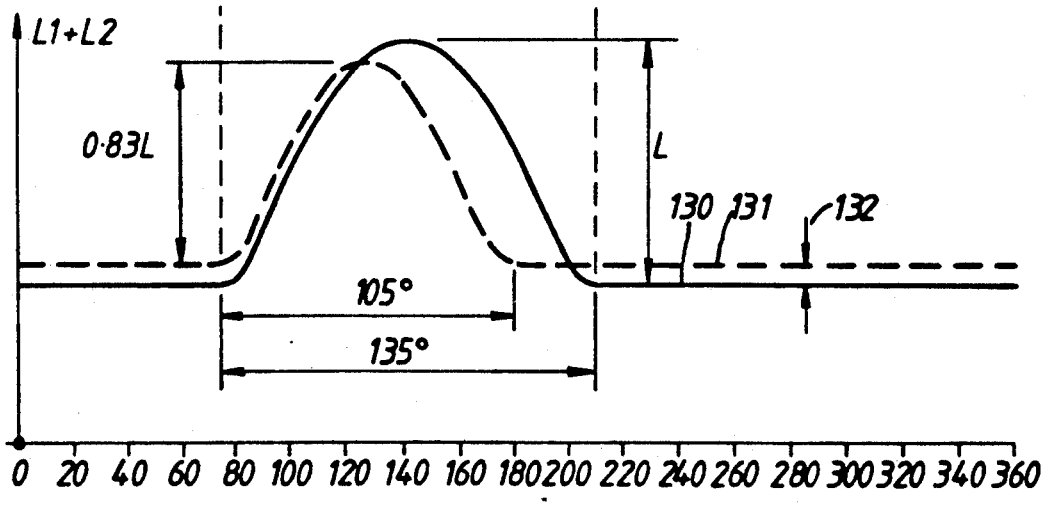
FIG. 14 shows the resultant of the lift of the two cams at differing valve periods.

FIG. 14 shows the change in resultant lift (L1+L2) of the two cams at differing valve periods. Line 130 shows the resultant at the maximum valve period. Line 131 shows the resultant at the minimum valve period. Two features should be noted: Firstly, the resultant lift decreases as the period is reduced. Secondly, the height of the baseline (horizontal portion) increases when the period is reduced which signifies an increase in the backlash. In an internal combustion engine for a vehicle, dimension 132 may be about 0.75 mm. Hence for high-speed applications it is highly desirable to use a hydraulic backlash adjuster to accommodate differences in the position of the baseline, i.e. differences in the size of the backlash, caused by changes in the phase of the cams.

Figure 15:
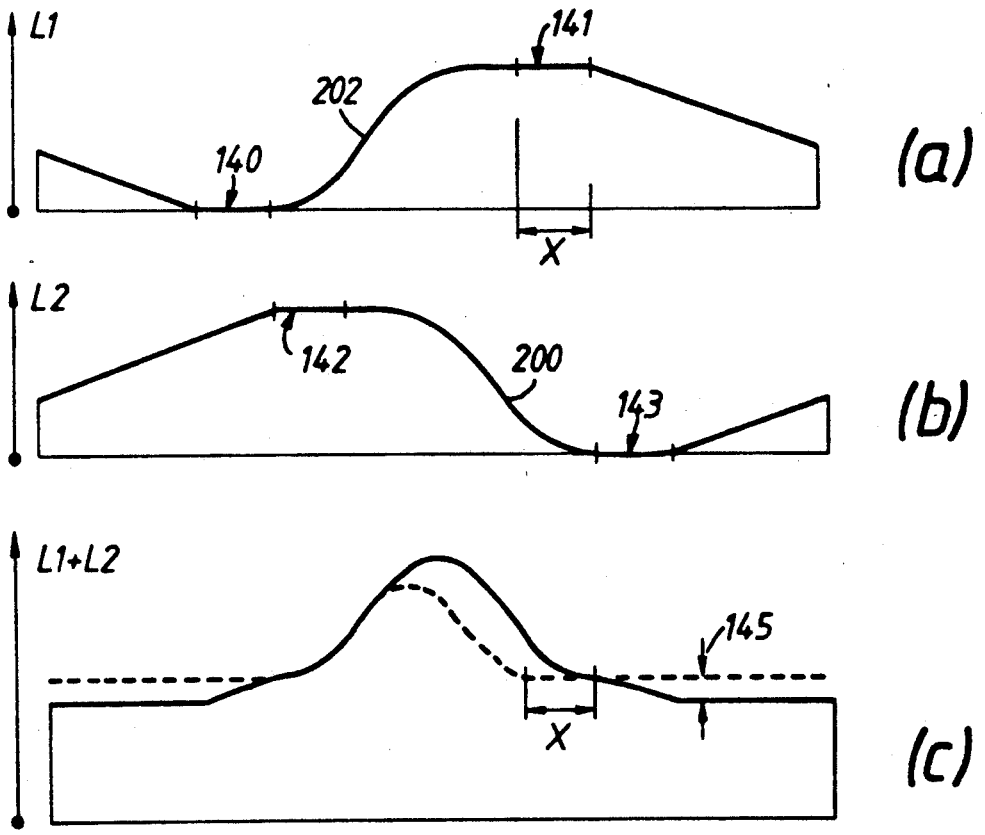
FIGS. 15*a–c* illustrate the lift characteristics of a fully mechanical valve gear with no automatic means for adjusting the backlash.

Although the use of a hydraulic backlash adjuster is preferred, a wholly mechanical system is possible by introducing horizontal portions into the cam lift profile 140, 141, 142, 143 as shown in FIG. 15. If mechanical backlash adjustment is used with the cam forms so far described, the valve motion is not optimum on seating and opening as the concave portions of the profile are ineffective when longer periods are used. This is because, at longer valve periods, the concave portions of the profile fall within the free movement (or partly within the free movement) of the follower rather than activating the valve. In practical terms this means that the valve would undergo very rapid acceleration on leaving its seat and very rapid deceleration on reseating. The effect of the horizontal portions of the cam profile is to ensure that the concave sections of the cam profile fall outside the free movement, at all valve periods (FIG. 15*c*). The length (X) of the horizontal portions (FIG. 15*a*) equals the length of the period of valve timing variation (FIG. 15*c*). Under these circumstances backlash occurs at all valve periods beyond the shortest period, and is a maximum (145) at the maximum valve-opening period.

Figure 16:
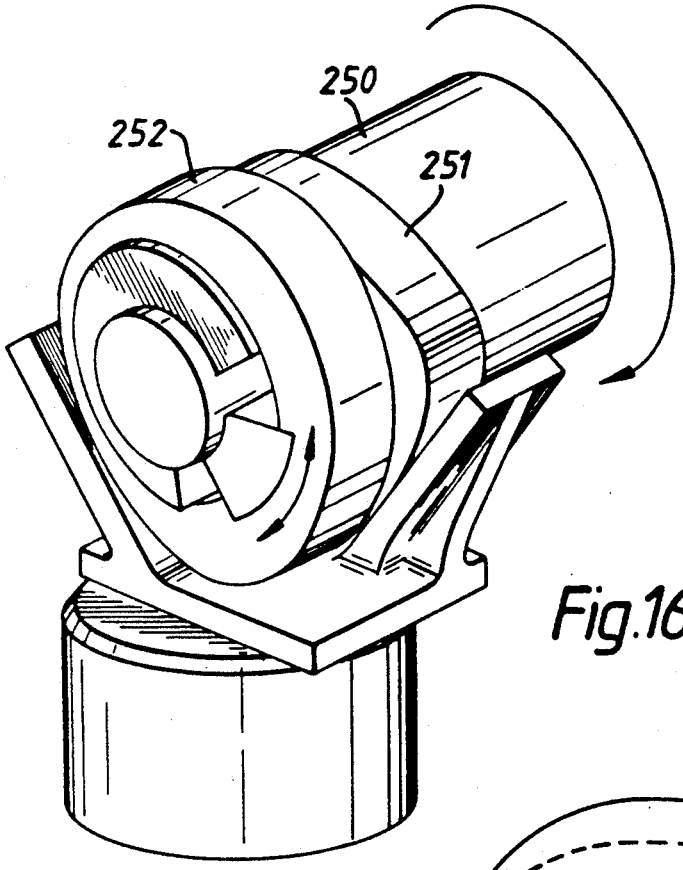
FIGS. 16 and 17 are a perspective and a transverse sectional view, respectively, of a part of a modified valve gear in which the two cams are carried by a single cam shaft.

In the embodiments described above the two cams are carried by separate parallel cam shafts. The means for altering the relative phase of two such cam shafts are well known to the expert in the art and one example thereof is disclosed in U.S. Pat. No. 3,109,417. However, such a phase change mechanism is relatively bulky and complex and in an alternative embodiment, which is illustrated in part in FIGS. 16 and 17, the two cams are carried on a single cam shaft which contains a phase change mechanism to rotate one cam relative to the other. This is known per se and one example is referred to as the Clemson Camshaft. However, the two cams usually act on the inlet and exhaust valves, respectively and not on the inlet valve, as in the present case. As may be seen in FIGS. 16 and 17, there is a single camshaft 250 which carries two cams 251 and 252 and is connected to a phase change mechanism (not shown) arranged to displace the two cams relative to one another about the axis of the cam shaft to change their phase. The cams engage respective contact surfaces on a common follower 253 afforded by respective upwardly extending lugs 254 and 255 which also extend outwardly at an angle of 15° to 70° to the valve axis. The follower is thus generally of V shape or divergent trough shape in end view. The base 256 of the follower 253 engages a tappet and in other respects the valve gear of FIGS. 16 and 17 is similar to that described above.

Figure 17:
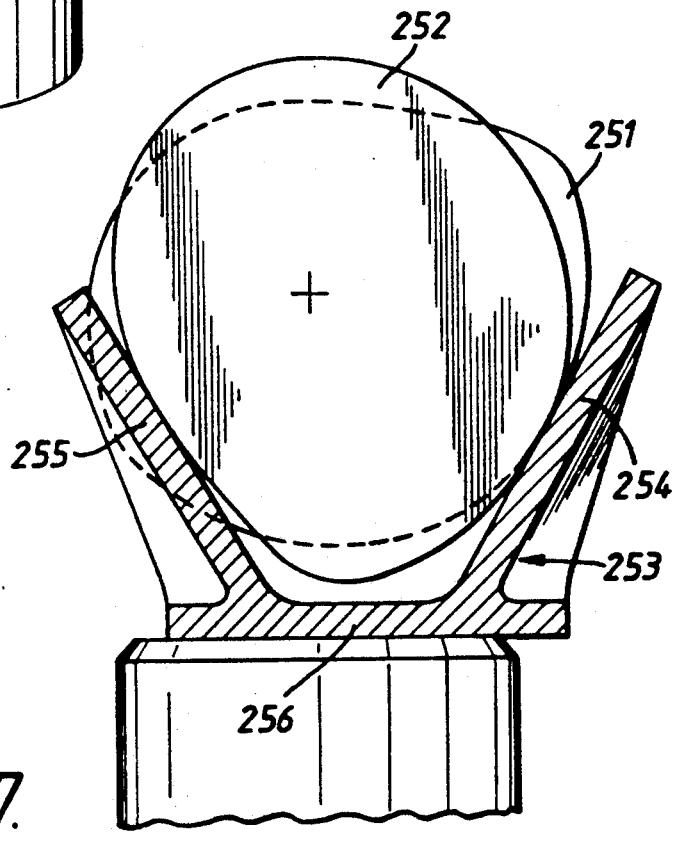
Figure 18:
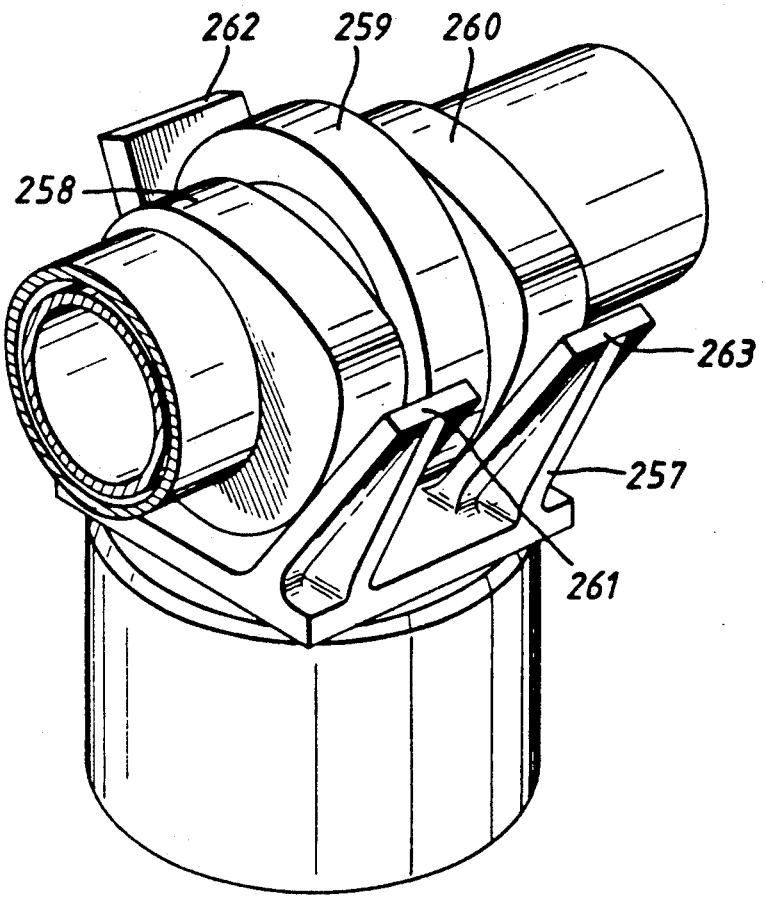
FIG. 18 is a perspective view in which the valve is operated by three cams carried on a single cam shaft.

A problem which results from the arrangement shown in FIG. 17 is that there is a tendency for the follower to rotate about the valve axis. A number of methods may be adopted to prevent this rotation and FIG. 18 shows one example.

One of the cams is split into two portions 258 and 260 whose shape and angular position are identical and which can move together but independently of the other cam 259 to alter the relative phase of the two cams. The follower 257 is similarly modified in that one of the inclined lugs is split into two portions 261 and 263 whose inner contact surfaces are acted on by a respective one of the cam halves 258 and 260 and which are spaced apart by a gap. Opposed to this gap is the other inclined lug 262 whose contact surface is engaged by the cam 259. This arrangement is inherently more stable than that shown in FIG. 17 and does not tend to cause rotation about the valve axis. In other respects, the construction of FIG. 18 is similar to that of the previous embodiments.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by Letters Patent of the United States is:

1. Valve gear for an internal combustion engine, said valve gear including a first cam mounted to rotate about a first axis, a second cam mounted to rotate about a second axis which is substantially parallel to said first axis, said first and second cams having respective actuating profiles, a phase-change mechanism arranged selectively to vary the phase of one of said cams relative to the other of said cams, a valve member movable along a valve axis, biassing means urging said valve member in a first direction along said valve axis and a cam follower which has first and second contact surfaces, said contact surfaces being arranged to be engaged by the actuating profile of said first and second cams, respectively, and being arranged to transmit movement from said cams to said valve member being movable with respect to said valve member, said actuating profile of said first cam including an ascending portion to move said valve member in a second direction opposite to said first direction and a descending ramp to control movement of said cam follower with respect to said valve member, said actuating profile of said second cam including a descending portion to control movement of said valve member in said first direction and an ascending ramp to control movement of said cam follower with respect to said valve member, the gradient of said ascending ramp and of said descending ramp being substantially the same over at least part of their length and the phase of said two cams being such that the times for which said ascending and descending ramps contact said follower at least partially overlap at a time during which said valve member is stationary in a closed position wherein said cam follower moves with respect to said valve member.

2. Valve gear as claimed in claim wherein the gradients of said ascending and descending ramps are substantially constant.

3. Valve gear as claimed in claim 1 further including a tappet which is engaged by said cam follower and which in turn engages said valve member, and a backlash adjuster, acting on said tappet whereby there is no backlash between said cams and said valve member.

4. Valve gear as claimed in claim wherein said actuating profile of each of said cams includes a portion of zero gradient adjacent the portion of maximum and of minimum lift.

5. Valve gear as claimed in claim 1 further including two parallel cam shafts, said two cams being carried by a respective one of said cam shafts.

6. Valve gear as claimed in claim 1 further including a single cam shaft, said two cams being carried by said single cam shaft.

7. Valve gear as claimed in claim 5 wherein said first and second contact surfaces are inclined to said valve axis by an acute angle of 15° to 70°, said cam follower being movable transverse to said valve axis by the engagement of said cams and being constrained to move only substantially parallel to a valve plane in which said valve axis lies and which extends perpendicular to said axes of said two cams.

8. Valve gear as claimed in claim 7 further including a tappet which includes an upstanding boss and which is engaged by said cam follower and in which in turn engages said valve member and wherein said cam follower has an elongate groove in its underside and said cam follower is constrained to move parallel to said valve plane by said upstanding boss which is received in said elongate groove.

9. Valve gear as claimed in claim 6 wherein said first and second contact surfaces are inclined to said valve axis by an acute angle of 15° to 70°, said cam follower being movable transverse to said valve axis by the engagement of said cams and being constrained to move only substantially parallel to a valve plane in which said valve axis lies and which extends perpendicular to said axes of said two cams.

10. Valve gear as claimed in claim 9 further including a tappet which includes an upstanding boss and which is engaged by said cam follower and in which in turn engages said valve member and wherein said cam follower has an elongate groove in its underside and said cam follower is constrained to move parallel to said valve plane by said upstanding boss which is received in said elongate groove.

11. Valve gear as claimed in claim 9 wherein said cam follower includes a base and two divergent lugs extending therefrom, said divergent lugs affording surfaces which constitute said contact surfaces.

12. Valve gear as claimed in claim 11 wherein one of said cams is divided into two portions whose shape and angular position are the same and which are spaced apart and separated by the other of said cams and one of said lugs of said cam follower is also divided into two spaced portions, said contact surfaces of which are engaged by a respective one of said cam portions.

* * * * *